US006315535B1

(12) United States Patent
Hoshi et al.

(10) Patent No.: US 6,315,535 B1
(45) Date of Patent: Nov. 13, 2001

(54) SCREW VACUUM PUMP HAVING VALVE CONTROLLED COOLING CHAMBERS

(75) Inventors: Toshiyasu Hoshi; Masashi Yoshimura, both of Yamaguchi (JP)

(73) Assignee: Taiko Kikai Industries, Co., Ltd. (JP)

( * ) Notice: Subject to any disclaimer, the term of this patent is extended or adjusted under 35 U.S.C. 154(b) by 0 days.

(21) Appl. No.: 09/647,251

(22) PCT Filed: Apr. 30, 1998

(86) PCT No.: PCT/JP98/01981

§ 371 Date: Sep. 22, 2000

§ 102(e) Date: Sep. 22, 2000

(87) PCT Pub. No.: WO99/50561

PCT Pub. Date: Oct. 7, 1999

(30) Foreign Application Priority Data

Mar. 31, 1998 (JP) ..... 10-087537

(51) Int. Cl.[7] ..... F04C 18/16; F04C 25/02; F04C 29/04

(52) U.S. Cl. ..... 418/2; 418/84; 418/87; 418/201.1

(58) Field of Search ..... 418/2, 84, 87, 418/201.1

(56) References Cited

FOREIGN PATENT DOCUMENTS

| | | | | |
|---|---|---|---|---|
| 61-152992 | | 7/1986 | (JP) . | |
| 0344344 | * | 12/1989 | (EP) | 418/2 |
| 2-149795 | * | 6/1990 | (JP) | 418/201.1 |
| 4-19385 | | 1/1992 | (JP) . | |
| 4-40186 | | 4/1992 | (JP) . | |

* cited by examiner

*Primary Examiner*—John J. Vrablik
(74) *Attorney, Agent, or Firm*—Baker & Daniels

(57) ABSTRACT

A discharge side housing 3 has a third cooling water chamber 19 communicating with a first cooling water chamber 7 of a main housing 1 through a cooling water passage 26. The third cooling water chamber 19 is connected to a cooling water outlet pipe 27 which is connected to an inlet port 28*a* of a three-way valve 28. The three-way valve 28 has a switching port 28*b* which can communicate with a pipe line 29 connected to the first cooling water chamber 7. The three-way valve 28 has an outlet 28*c* connected to a pipe line 30 which communicates with a second cooling water chamber 22 of a suction side housing 2. The second cooling water chamber 22 is connected to a cooling water discharge line 31 provided with a flow control valve 32 allowing a back pressure for a cooling water flowing thereinto.

6 Claims, 6 Drawing Sheets

SCREW VACUUM PUMP HAVING VALVE CONTROLLED COOLING CHAMBERS

FIELD OF THE INVENTION

The present invention relates to a screw rotor type dry vacuum pump which is used, for example, in a semiconductor producing apparatus. The vacuum pump is also sufficiently applicable to a hard process in which substances produced in a reaction of a process gas accumulates in the vacuum pump.

BACKGROUND OF THE INVENTION

FIG. 5 is a longitudinal sectional view showing the construction of a vacuum pump. The vacuum pump has a main housing 1, a suction side housing 2 attached on a right end surface of the main housing 1, a discharge side housing 3 attached on a left end surface of the main housing 1, and a gear housing 4 mounted in the left side of the discharge side housing 3. On a left end portion of the gear housing 4, a motor 5 is mounted.

The main housing 1 is provided with an inner cylinder 1*a* longitudinally extending therethrough, a suction port 6 externally cummunicating with the inner cylinder la at a right side of the inner cylinder 1*a,* and a cooling water chamber 7 for cooling a wall of the main housing 1.

The inner cylinder 1*a* accommodates a pair of screw rotors 8 engaging with each other (only one of them is illustrated in FIG. 5).

The suction side housing 2 is formed with two recesses in which a pair of bearing caps 9 (only one of them is illustrated in FIG. 5) are received to be secured therein. Each bearing cap 9 accommodates a bearing 10 for rotatably supporting a shaft 8*a* extending from a right end of the screw rotor 8.

The discharge side housing 3 is formed with two recesses in which a pair of bearing caps 11 (only one of them is illustrated in FIG. 5) are received to be secured therein. Each bearing cap 11 accommodates a bearing 12 for rotatably supporting a shaft 8*a* extending from a left end of the screw rotor 8.

Each screw rotor 8 has a tooth portion 8*b* engaging with another tooth portion 8*b* of the opposing screw rotor 8. One of the screw rotors 8 is a driving rotor. On an outer surface of the left side shaft 8*a* of the driving rotor, a timing gear 24 is secured. In a left side of the timing gear 24, there is mounted a coupling 25 which is coupled to an output shaft 5*a* of the motor 5.

The other screw rotor 8, which is driven by the rotation of the one of the screw rotors 8, has another timing gear (not shown) engaging with the former timing gear 24 and secured on a shaft 8*a* attached on a left portion of the other screw rotor 8.

The rotation of the screw rotor 8 draws in a fluid (a gas) from the suction port 6 to discharge it from a discharge port 13.

The vacuum pump generates heat during its operation to heat itself up to a high temperature. This high temperature causes a damage of an oil seal or a lip seal for axially sealing the shaft of the screw rotor 8 or of the bearing supporting each end of the screw rotor 8. The high temperature may also cause another problem such as seizing of the screw rotors 8. Therefore, a water cooling system has to be provided for the vacuum pump.

Thus, the discharge side housing 3 is provided with the discharge port 13 communicating with the inner cylinder la and a cooling water chamber 19 for cooling a wall of the discharge side housing 3.

The gear housing 4, which is cylindrical, has a cooling water chamber 14 on an outer surface thereof, and a cooling water chamber 15 is provided on an outer surface of the motor 5.

The cooling water of the vacuum pump flows, as illustrated in FIG. 6, into the cooling water chamber 15 of the motor 5 through a cooling water supply line 16 to cool the motor 5 and thereafter is delivered into the cooling water chamber 14 of the gear housing 4 through a connecting pipe 17 to cool the gear housing 4.

The cooling water which has cooled the gear housing 4 flows through a connecting pipe 18 into the cooling water chamber 19 of the discharge side housing 3 to cool the discharge side housing 3 and then is delivered into the cooling water chamber 7 of the main housing 1 through a connecting pipe 20. After the cooling water has cooled the main housing 1, the cooling water flows through a connecting pipe 21 into a cooling water chamber 22 of the suction side housing 2 to cool the suction side housing 2 and finally is discharged from a discharge line 23.

Thus, the heat generated in operation of the vacuum pump is removed.

A dry vacuum pump used in a semiconductor producing apparatus has to accomplish a vacuum degree of the order of 1 Pa (of $10^{-3}$ Torr). When a gas handled by the vacuum pump is finally discharged into the atmosphere, the gas should be compressed at a compression rate of the order of $10^5$ before the discharge, generating a large amount of heat due to the compression.

Therefore, a cooling system with a cooling water is inevitable for the vacuum pump as well as a general vacuum pump. However, a disadvantage of the vacuum pump remains as described in the following.

The cooling of the main housing 1 of the dry vacuum pump cools a process gas flowing in the main housing 1, so that substances such as AlCl and $NH_3Cl$ contained in the gas changes into solids which deposit on the inner cylinder 1*a* or on the screw rotors 8. The deposits block a clearance between the pair of the screw rotors 8 and a clearance between the screw rotors and the inner cylinder 1*a,* interrupting the rotation of the screw rotors 8.

The vacuum pump has been used in various applications in semiconductor producing steps. For example, the vacuum pump is used in a light process generally called as a clean process in which no deposits are generated. The light process, in which a conventional vacuum pump may be used with no problem, is applied in a load lock process and a sputtering process. However, deposits are generated during a process of CVD (Chemical Vapor Deposition) such as Nitride or Teos for covering a thin film on a wafer. Also, deposits are generated during an Al etching process.

During the Nitride process, chemical substances react as follows.

$$SiH_2Cl+NH_3 \rightarrow Si_3N_4+NH_4Cl$$

During the Al etching process, chemical substances react as follows.

$$Al+Cl_2 \rightarrow AlCl_2$$

That is, the solid of $NH_4Cl$ or $AlCl_2$ is produced.

$NH_4Cl$ sublimes to become a gas from a solid at a temperature more than 180° C. under a normal atmospheric pressure. $NH_3Cl$ sublimes at a temperature of around 338° C.

In a vacuum state in which only an attenuated gas is existing, no deposits are generated. Thus, a method, in which $N_2$ is purged into a discharge side of the screw rotor, has been proposed to prevent the generation of deposits in a compression stage. However, the method is still insufficient.

Furthermore, in the semiconductor producing process including a light process and a hard process, it is disadvantageous for management of the producing process in that the two types of vacuum pumps have to be prepared for an alternate use thereof.

The present invention can be applied to a method including a $N_2$ purge step and a heating step. However, in the heating step, a conventional electric heater is not used, but the deposit generation is limited by controlling heat generated by compression during operation of a vacuum pump. Furthermore, the present invention provides a dry vacuum pump which is advantageously used for a light process and also for a heavy process with a one-touch switching operation.

SUMMARY OF THE INVENTION

For achieving the above-mentioned object, a vacuum pump according to the present invention includes an inner cylinder accommodating a pair of screw rotors engaging with each other, a suction port communicating with one side of the inner cylinder, and a discharge port communicating with another side of the inner cylinder. The vacuum pump also includes a main housing having an outer wall on which a first cooling water chamber is provided, a suction side housing attached on one end of the main housing and having an outer wall on which a second cooling water chamber is provided, and a discharge side housing attached on another end of the main housing and having an outer wall on which a third cooling water chamber is provided. The third cooling water chamber 19 of the discharge side housing communicates with the first cooling water chamber of the main housing through a cooling water passage. The third cooling water chamber of the discharge side housing has a cooling water outlet pipe which is connected to an inlet of a three-way valve. The three-way valve has a switching port which can communicate with the first cooling water chamber of the main housing. The three-way valve has an outlet which is connected to the second cooling water chamber of the suction side housing. The second cooling water chamber of the suction side housing is connected to a cooling water discharge line provided with a valve.

Preferably, the valve provided in the cooling water discharge line is a flow control valve. The vacuum pump may have a temperature sensor for detecting whether a temperature of the main housing becomes more than a predetermined value and may also have a warning device for warning of the open degree of the flow control valve based on a sensed signal of the temperature sensor.

Alternatively, the vacuum pump may have a temperature sensor for detecting whether a temperature of the main housing becomes more than a predetermined value and may also have a control device for automatically controlling the open degree of the flow control valve 32 based on a sensed signal of the temperature sensor.

PREFERRED EMBODIMENT

Referring to the accompanied drawings, an embodiment of the present invention will be discussed hereinafter.

Figure 1:
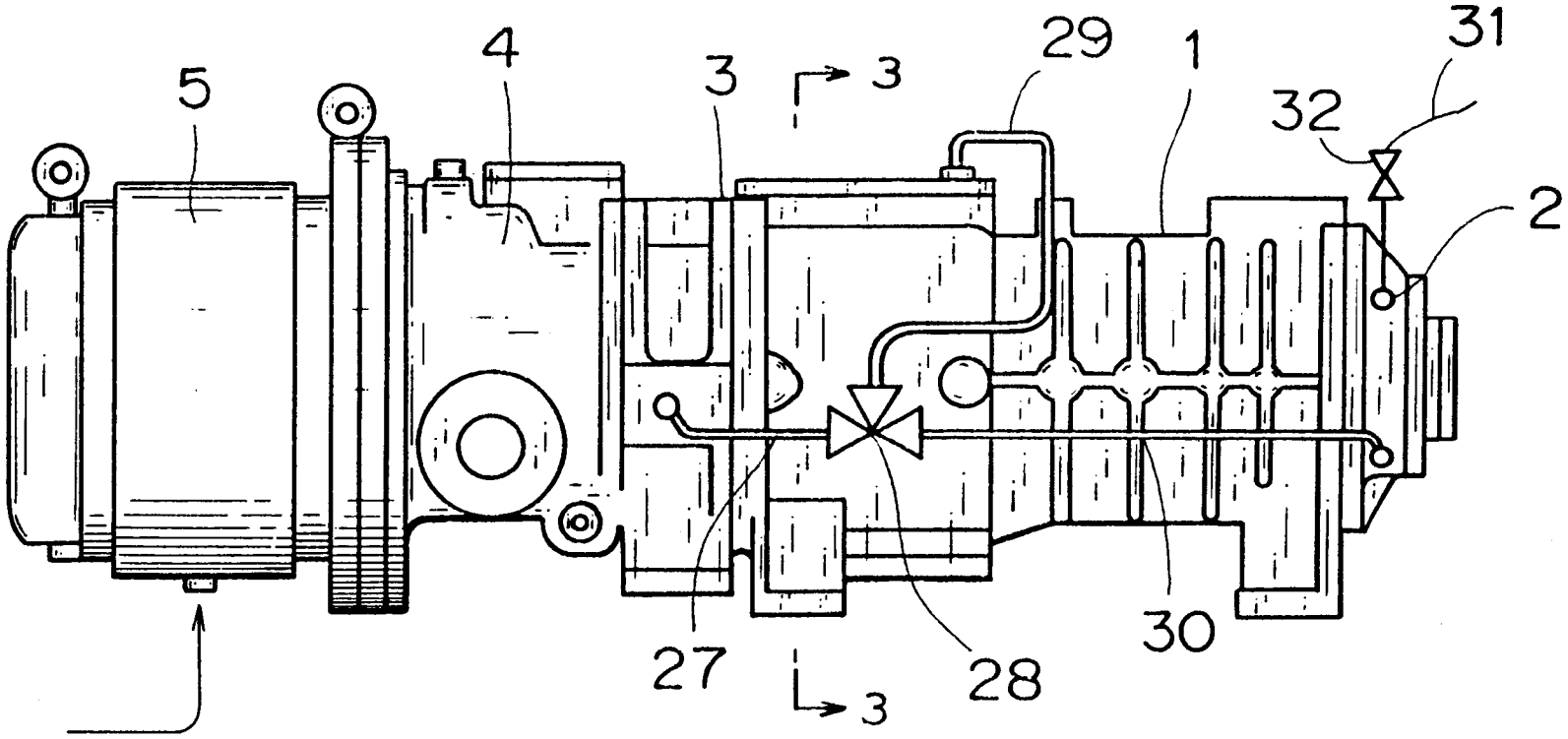
FIG. 1 is a front view showing a dry vacuum pump according to the present invention.
Figure 2:
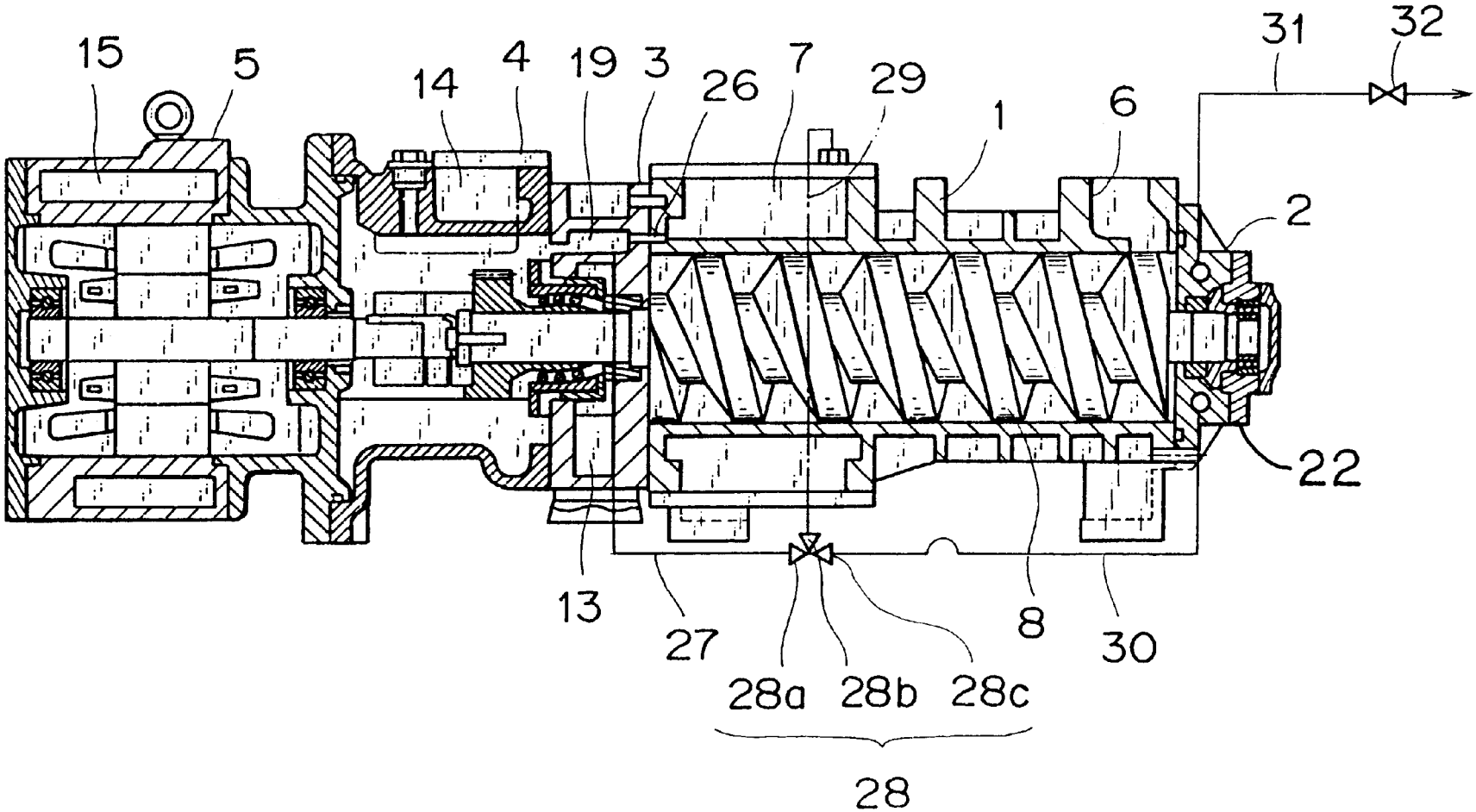
FIG. 2 is a cross-sectional view of FIG. 1.
Figure 3:
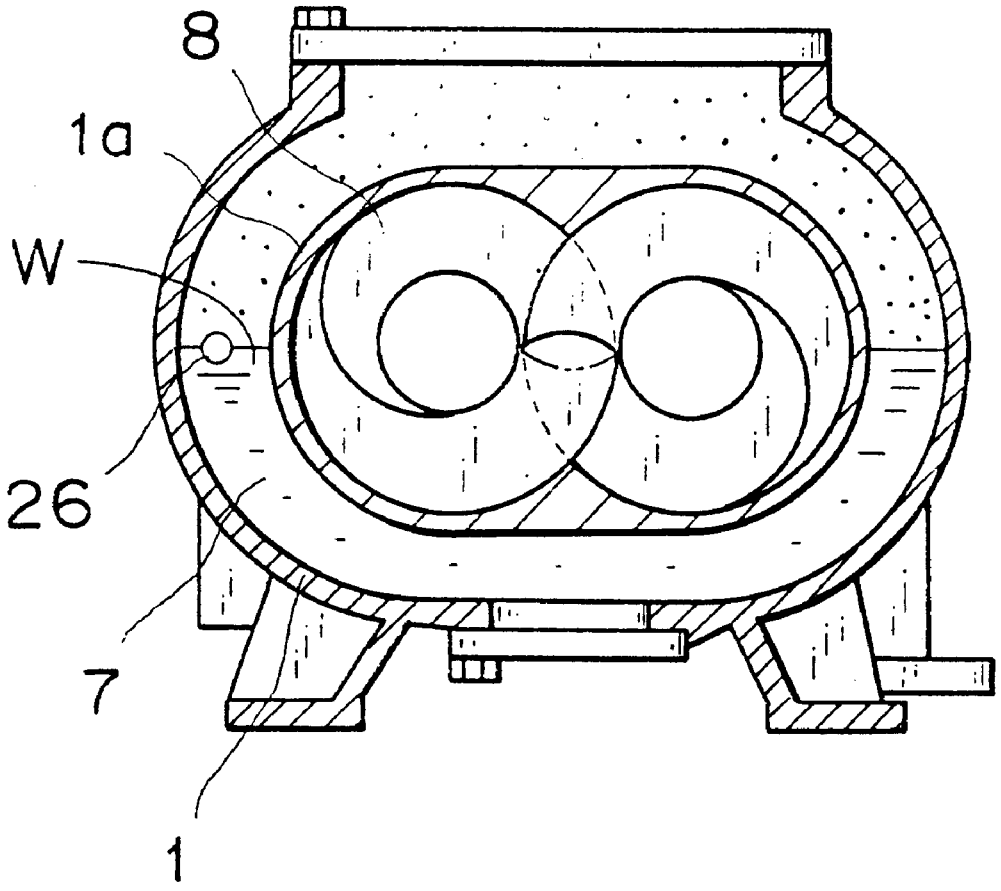
FIG. 3 is a sectional view taken along line 3—3 of FIG. 1.
Figure 4:
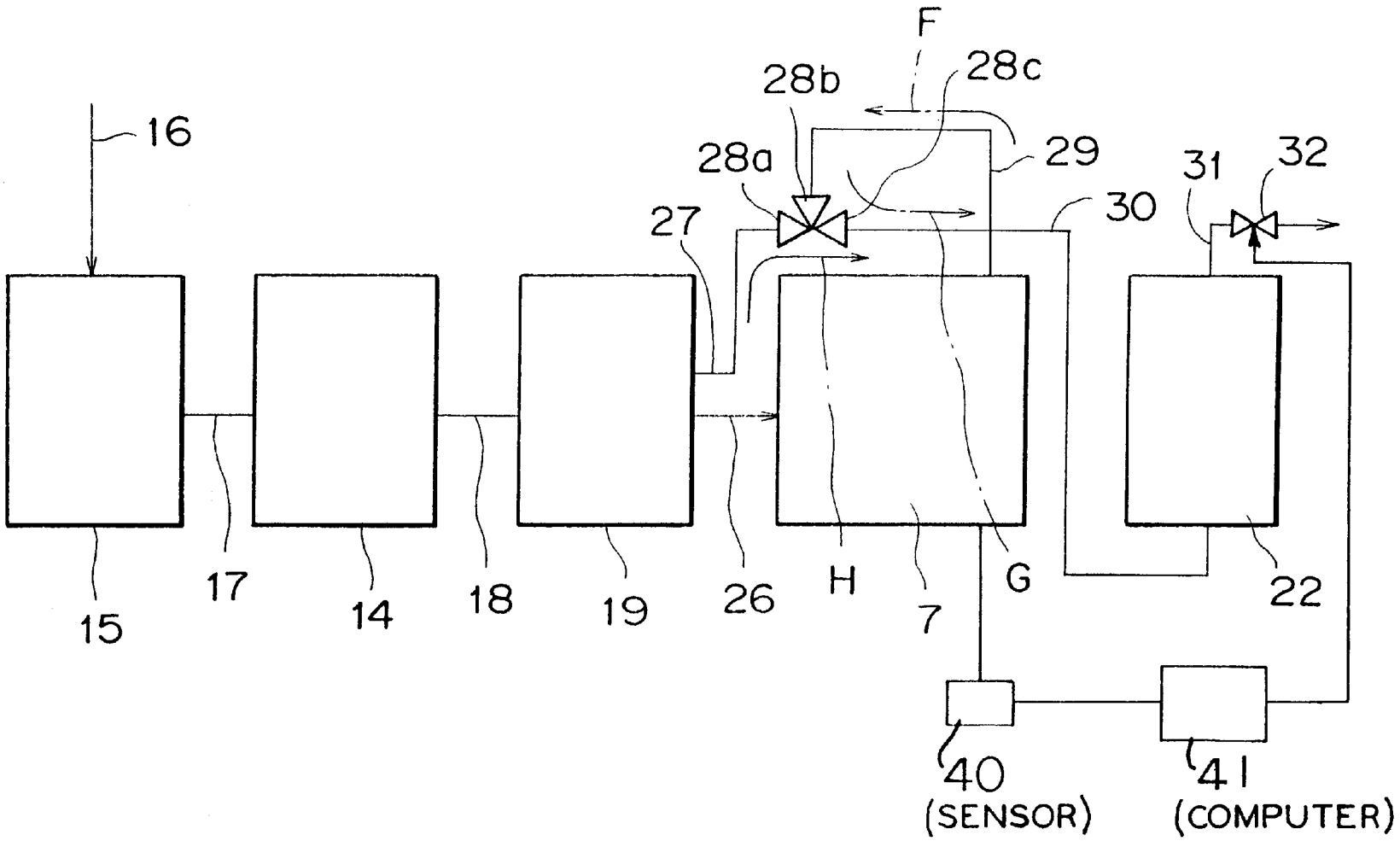
FIG. 4 is an illustration showing a piping arrangement for a cooling water of the vacuum pump.
Figure 5:
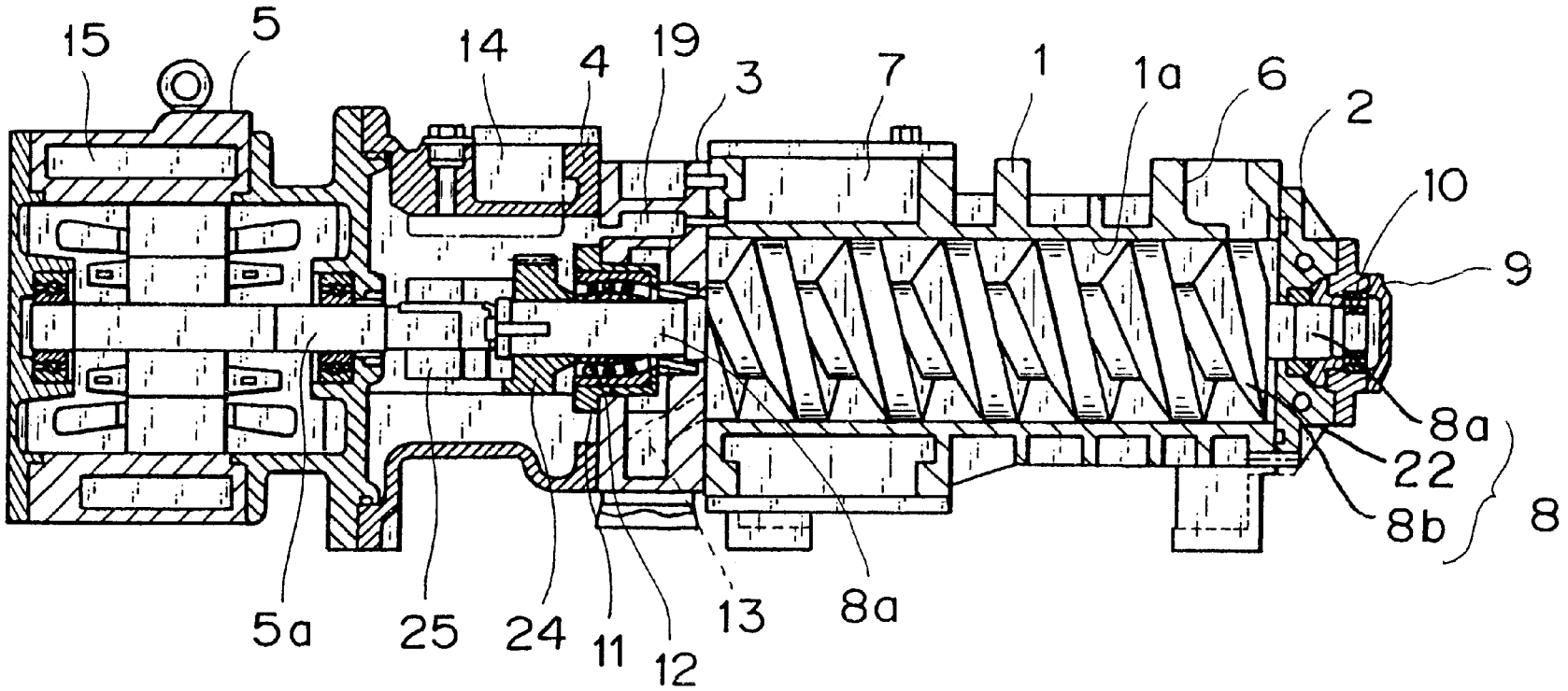
FIG. 5 (PRIOR ART)
FIG. 5 is a cross-sectional view showing an inner structure of a conventional vacuum pump.
Figure 6:
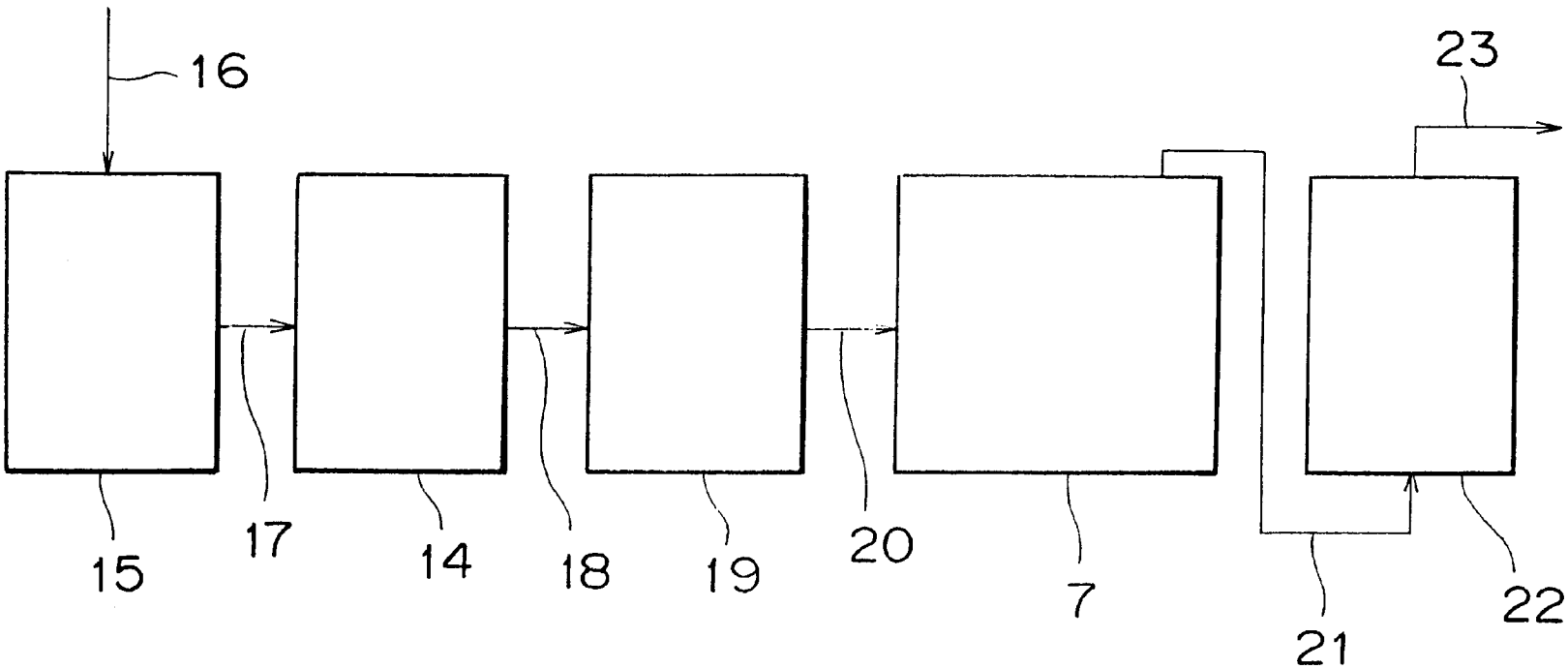
FIG. 6 (PRIOR ART)
FIG. 6 is an illustration showing a piping arrangement for a cooling water of a conventional vacuum pump.

FIG. 1 is a front view showing a dry vacuum pump according to the present invention; FIG. 2 is a cross-sectional view of FIG. 1; FIG. 3 is a sectional view taken along line 3—3 of FIG. 1; and FIG. 4 is an illustration showing a piping arrangement for a cooling water of the vacuum pump.

Since the dry vacuum pump has a structure based on the conventional one, the components same as those of the conventional one each have a reference numeral the same as one of the conventional one and are not discussed again. Only features of the embodiment which are different from the conventional one will be discussed hereinafter.

A third cooling water chamber 19 of a discharge side housing 3 communicates with a first cooling water chamber 7 of a main housing 1 through a cooling water passage 26. The third cooling water chamber 19 of the discharge side housing 3 communicates with a cooling water outlet pipe 27 which is connected to an inlet port 28*a* of a three-way valve 28.

The three-way valve 28 has a switching port 28*b* which can communicate with the first cooling water chamber 7 of the main housing 1. The three-way valve 28 has an outlet port 28*c* which is connected to a pipe line 30 communicating with a second cooling water chamber 22 of a suction side housing 2. The second cooling water chamber 22 is connected to a cooling water discharge line 31 provided with a flow control valve 32 for controlling a back pressure of a cooling water flowing thereinto.

When the switching of the three-way valve 28 and the operation of the flow control valve 32 are carried out by hand, there is provided a warning device 41 (not shown). The warning device gives an alarm when a temperature sensor 40 (not shown) detects that a temperature of the main housing 1 becomes more than a predetermined value.

Meanwhile, when the switching of the three-way valve 28 and the operation of the flow control valve 32 are automatically carried out, there is provided a control and warning device 41 for the switching of the three-way valve 28 and for the operation of the flow control valve 32 based on signals detected by the temperature sensor 40.

Operation of thus constituted dry vacuum pump, which is applied to a light process and to a heavy process, will be discussed hereinafter.

In the light process, regarding the three-way valve 28, the switching port 28*b* is open and the inlet port 28*a* is closed.

In this state, the cooling water flows sequentially through the cooling water supply line 16, a cooling water chamber 15 of a motor 5, a connecting pipe 17, a cooling water chamber 14 of the gear housing 4, the connecting pipe 18, and the cooling water chamber 19 of the discharge side housing 3. Then, the cooling water further flows into the first cooling water chamber 7 of the main housing 1 through the cooling water passage 26.

Thus, the main housing 1 is cooled, so that the temperature of a gas flowing through the main housing 1 becomes around 150° C.

The cooling water which has passed through the first cooling water chamber 7 flows through a pipe passage 29 in a direction shown by an arrow F. Then, the cooling water flows through the switching port 28*b* of the three-way valve 28 into the pipe line 30 in a direction shown by an arrow G and further flows through the pipe line 30 into the second cooling water chamber 22 of the suction side housing 2 to be finally discharged from the cooling water discharge line 31.

In the heavy process, regarding the three-way valve 28, the switching port 28*b* is closed and the inlet port 28*a* open.

Thereby, the cooling water flows sequentially through the cooling water chamber 19 of the discharge side housing 3, the cooling water outlet pipe 27, and the inlet port 28*a* of the three-way valve 28 in a direction shown by an arrow H into the pipe line 30.

When the temperature of a water filling the first cooling water chamber 7 of the main housing 1 becomes more than 100° C. due to heat generated by compression of a gas in the inner cylinder 1*a,* vaporization of the water increases the inside pressure of the first cooling water chamber 7. The pressure increase discharges partially the water into the cooling water chamber 19 of the discharge side housing 3 through the cooling water passage 26 (see FIG. 3) to mix it with a cooling water filling the discharge side housing 3.

In this state, operating the flow control valve 32 toward its closed position to increase the pressure drop therein causes that the vapor temperature in the first cooling water chamber 7 becomes higher than 100° C. to increase the temperature of the main housing 1.

By heating the main housing 1 up to a temperature of 100° C. to 120° C., a gas discharged from the main housing 1 is adjusted to have a temperature of around 350° C.

Since the vaporization temperatures of $NH_4Cl$, $AlCl_2$, etc. are lower than 350° C. (under a pressure of 760 Torr), the deposit accumulation is not initiated in the main housing 1, preventing a shutdown of the vacuum pump due to a piled-up deposit therein.

Furthermore, the control of the flow control valve 32 can prevent an excessive temperature increase of the main housing 1. This eliminates the reduction of a service life of the vacuum pump and a fear of burns due to an excessive temperature increase of the main housing 1.

A temperature sensor (not shown) is provided in the first cooling water chamber 7 of the main housing 1 for detecting whether an inside temperature of the first cooling water chamber 7 is higher than a predetermined value. In addition, a warning device is provided for giving an alarm based on a detected signal of the temperature sensor. Thereby, an operator who has heard the alarm operates the flow control valve 32 to control the temperature of a gas discharged from the main housing 1 to be around 350° C.

A control device for automatically controlling an opening/closing mechanism of the flow control valve based on a detected signal of the temperature sensor may be provided, which eliminates the manual operation of the flow control valve.

Industrial Applicability of the invention

The present invention, which is constituted as described above, has operational effects as described hereinafter:

(1) The dry vacuum pump according to the present invention is commonly used in a light process and in a hard process by switching of the three-way valve.

(2) When the vacuum pump is used in a hard process, the flow control valve is controlled in the open degree thereof to adjust the back pressure of the cooling water so that the temperature of the main housing is controlled.

Controlling the casing temperature to be at an adequate value can prevent the pileup of deposits and can prevent an excessive temperature increase of the vacuum pump.

What is claimed is:

1. A vacuum pump comprising an inner cylinder accommodating a pair of screw rotors engaging with each other, a suction port communicating with one side of the inner cylinder, a discharge port communicating with another side of the inner cylinder, a main housing having an outer wall on which a first cooling water chamber is provided, a suction side housing attached on one end of the main housing and having an outer wall on which a second cooling water chamber is provided, and a discharge side housing attached on another end of the main housing and having an outer wall on which a third cooling water chamber is provided, wherein the third cooling water chamber of the discharge side housing communicates with the first cooling water chamber of the main housing through a cooling water passage, and the third cooling water chamber of the discharge side housing has a cooling water outlet pipe which is connected to an inlet of a three-way valve, said three-way valve having a switching port which can communicate with the first cooling water chamber of the main housing, said the three-way valve having an outlet which is connected to the second cooling water chamber of the suction side housing, the second cooling water chamber being connected to a cooling water discharge line provided with a valve.

2. The vacuum pump set forth in claim 1 wherein the vacuum pump has a temperature sensor for detecting whether a temperature of the main housing becomes more than a predetermined value and a warning device for warning of the open degree of the valve based on a sensed signal of the temperature sensor.

3. The vacuum pump set forth in claim 1 wherein the vacuum pump has a temperature sensor for detecting whether a temperature of the main housing becomes more than a predetermined value and a warning device for warning of the open degree of the flow valve based on a sensed signal of the temperature sensor.

4. The vacuum pump set forth in claim 1 wherein said valve provided in the cooling water discharge line is a flow control valve.

5. The vacuum pump set forth in claim 4 wherein the vacuum pump has a temperature sensor for detecting whether a temperature of the main housing becomes more than a predetermined value and a warning device for warning of the open degree of the valve based on a sensed signal of the temperature sensor.

6. The vacuum pump set forth in claim 4 wherein the vacuum pump has a temperature sensor for detecting whether a temperature of the main housing becomes more than a predetermined value and a control device for automatically controlling the open degree of the flow control valve based on a sensed signal of the temperature sensor.

* * * * *

UNITED STATES PATENT AND TRADEMARK OFFICE

CERTIFICATE OF CORRECTION

PATENT NO. : 6,315,535 B1
DATED : November 13, 2001
INVENTOR(S) : Hoshi et al.

It is certified that error appears in the above-identified patent and that said Letters Patent is hereby corrected as shown below:

Column 6,
Lines 42-47, please amend Claim 3 to read as follows:
-- 3. The vacuum pump set forth in claim 1 wherein the vacuum pump has a temperature sensor for detecting whether a temperature of the main housing becomes more than a predetermined value and a control device for automatically controlling the open degree of the flow control valve based on a sensed signal of the temperature sensor. --

Signed and Sealed this

Twenty-third Day of April, 2002

*Attest:*

*Attesting Officer*

JAMES E. ROGAN
*Director of the United States Patent and Trademark Office*